US009805884B2

(12) United States Patent
Nakase et al.

(10) Patent No.: US 9,805,884 B2
(45) Date of Patent: Oct. 31, 2017

(54) SWITCH HAVING IMPROVED COVER

(71) Applicant: FOXCONN INTERCONNECT TECHNOLOGY LIMITED, Grand Cayman (KY)

(72) Inventors: Yusho Nakase, Yokohama (JP); Liang Sun, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 4 days.

(21) Appl. No.: 14/841,551

(22) Filed: Aug. 31, 2015

(65) Prior Publication Data

US 2016/0064159 A1 Mar. 3, 2016

(30) Foreign Application Priority Data

Aug. 29, 2014 (CN) ..... 2014 2 0493306 U

(51) Int. Cl.
*H01H 13/04* (2006.01)
*H01H 1/58* (2006.01)
*H01H 13/14* (2006.01)

(52) U.S. Cl.
CPC ..... *H01H 13/04* (2013.01); *H01H 1/5805* (2013.01); *H01H 13/14* (2013.01); *H01H 2207/004* (2013.01); *H01H 2207/012* (2013.01); *H01H 2207/02* (2013.01); *H01H 2223/008* (2013.01); *H01H 2223/054* (2013.01)

(58) Field of Classification Search
CPC ..... H01H 1/5805; H01H 2001/5888; H01H 13/04; H01H 13/14; H01H 2207/004
USPC ..... 200/292, 406, 294; 215/379, 384
See application file for complete search history.

(56) References Cited

U.S. PATENT DOCUMENTS

2005/0029084 A1* 2/2005 Watanabe ..... H01H 1/5805 200/406
2007/0215450 A1* 9/2007 Sun ..... H01H 15/06 200/550
2012/0175231 A1* 7/2012 Chung ..... H01H 19/005 200/316

FOREIGN PATENT DOCUMENTS

CN 202585176 12/2012

* cited by examiner

*Primary Examiner* — Edwin A. Leon
*Assistant Examiner* — Ahmed Saeed
(74) *Attorney, Agent, or Firm* — Wei Te Chung; Ming Chieh Chang

(57) ABSTRACT

An electrical switch (120) includes an insulative housing (121), the operation part (150) disposed in the housing (121), and the metallic cover (160) enclosing the housing (121). The metallic cover (160) includes a front plate (161), a pair of side plates (164) extending rearwardly from two opposite lateral sides of the front plate (161). The side plate (164) include a main body (165) to cover the corresponding side wall (125) of the housing and an extension (167) extending beyond a rear face of the housing (121) and adapted to be soldered upon a printed circuit board (110) on which the housing (121) is seated.

5 Claims, 5 Drawing Sheets

SWITCH HAVING IMPROVED COVER

BACKGROUND OF THE INVENTION

1. Field of the Invention

The present invention relates generally to an switch, and more particularly to a switch having an improved soldering structure to resist the operation forces.

2. Description of Related Arts

The traditional electrical switch as disclosed in CN202585176U issued on Dec. 5, 2012, includes an insulative housing with an opening, a plurality of fixed contacts retained in the housing, a moveable contact corresponding to the fixed contacts, a cap or operation part adapted to press the movable contact, and a metallic cover covering the housing. The metallic cover includes a front plate and a pair of side plates extending from the lateral sides of the front plate. The side plate further includes an extension soldered upon the printed circuit board. Anyhow, the cover forms only two soldering positions with less strength thereof.

A new switch having a better soldering arrangement is desired.

SUMMARY OF THE INVENTION

Accordingly, an object of the present invention is to provide a switch with the stronger soldering.

To achieve the above object, an electrical switch includes an insulative housing, the operation part disposed in the housing, and the metallic cover enclosing the housing. The metallic cover includes a front plate, a pair of side plates extending rearwardly from two opposite lateral sides of the front plate. The side plate include a main body to cover the corresponding side wall of the housing and an extension extending beyond a rear face of the housing and adapted to be soldered upon a printed circuit board on which the housing is seated. Understandably, compared with the aforementioned prior art, in the instant invention because the soldering positions are located behind the rear face of the housing, thus efficiently resisting the operation force imposed upon the housing.

DETAILED DESCRIPTION OF THE PREFERRED EMBODIMENT

Reference will now be made in detail to the preferred embodiment of the present invention.

Figure 1:
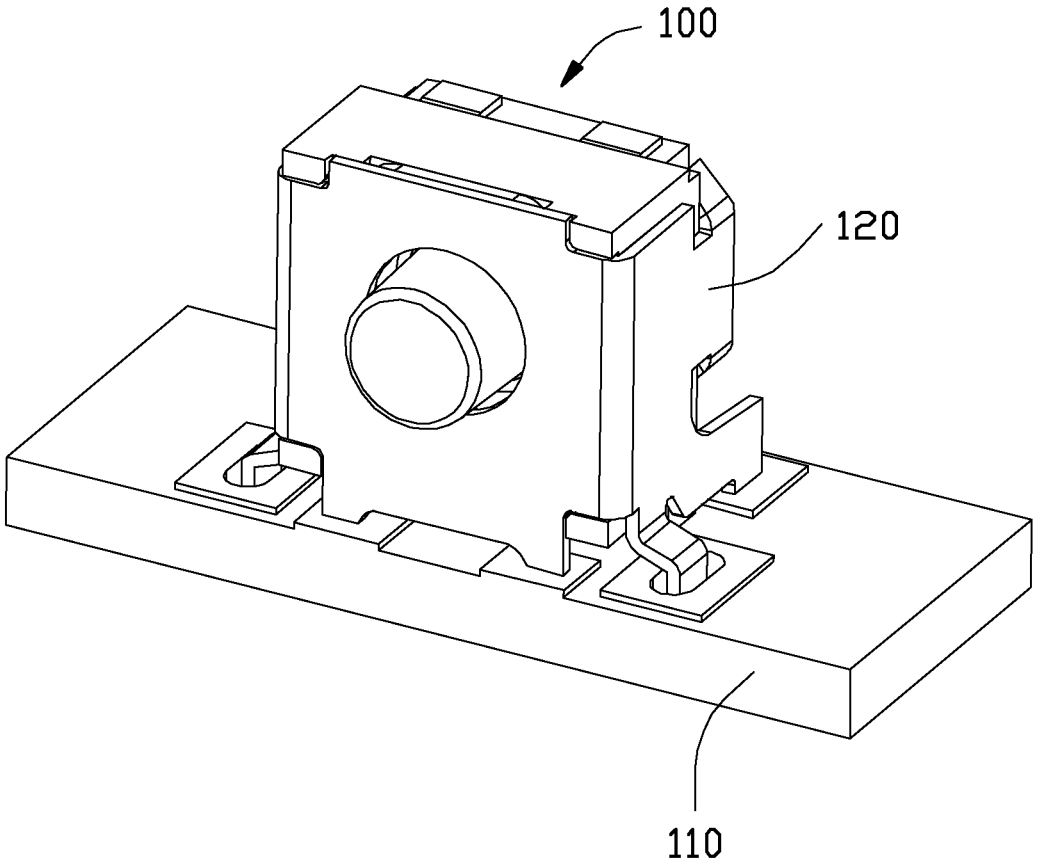
FIG. 1 is a front assembled perspective view of a preferred embodiment of an electrical switch according to the invention.
Figure 2:
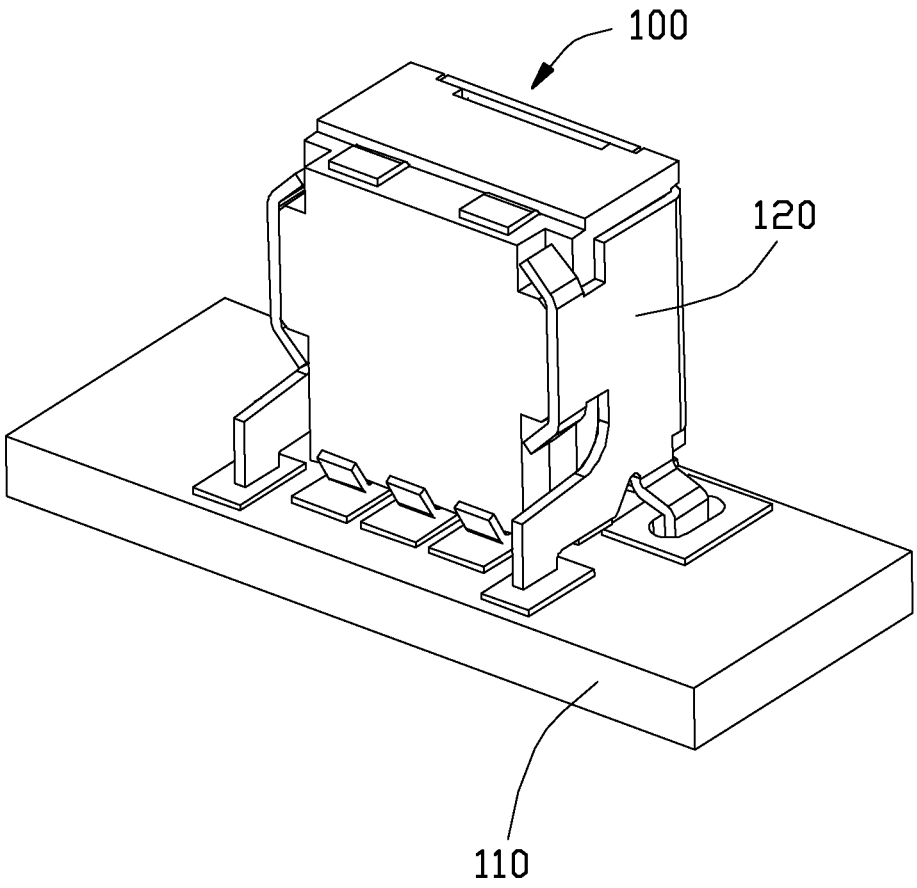
FIG. 2 is a rear assembled perspective view of the switch of FIG. 1.
Figure 3:
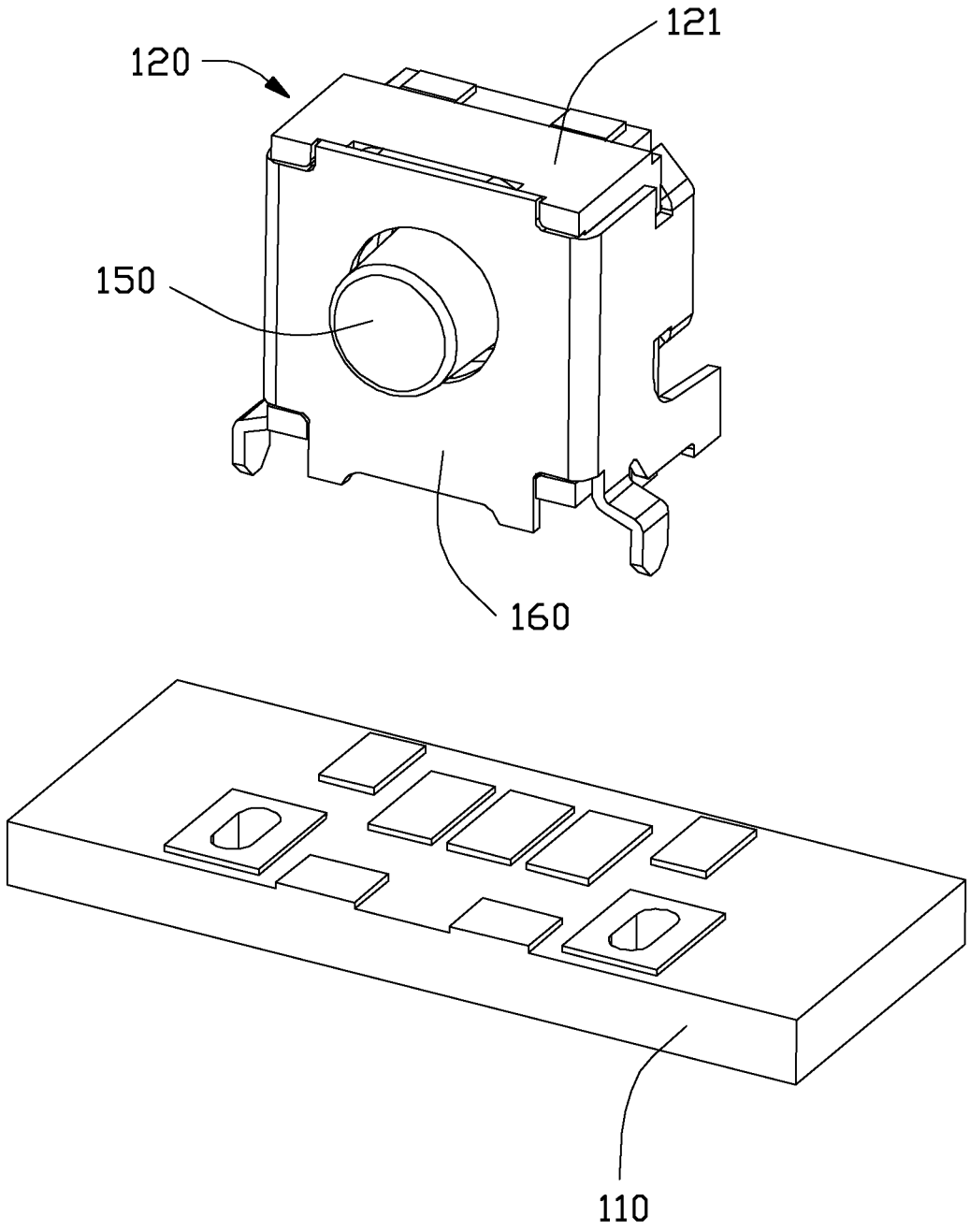
FIG. 3 is a front exploded perspective view of the switch of FIG. 1.
Figure 4:
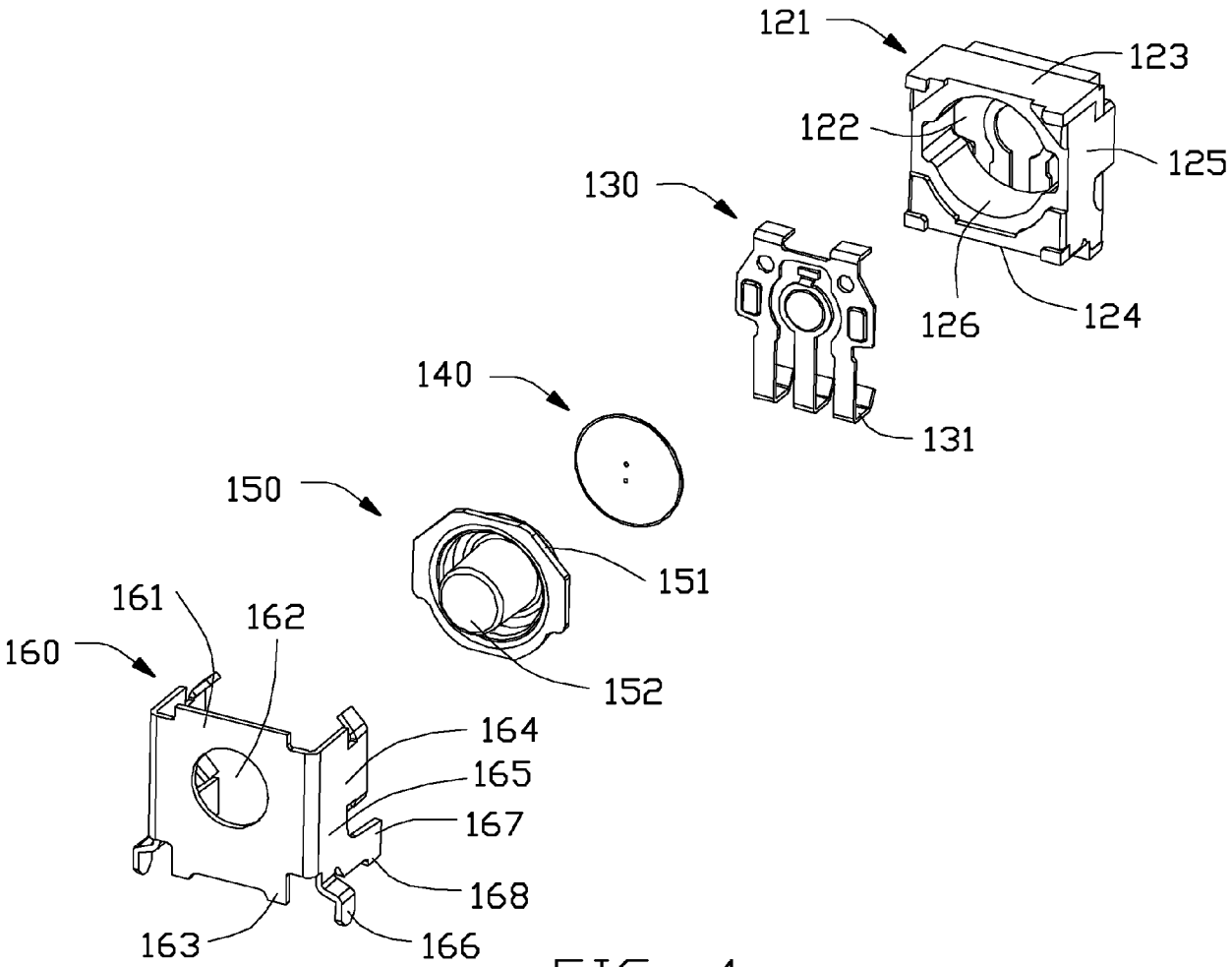
FIG. 4 is a further exploded perspective of the switch of FIG. 3.
Figure 5:
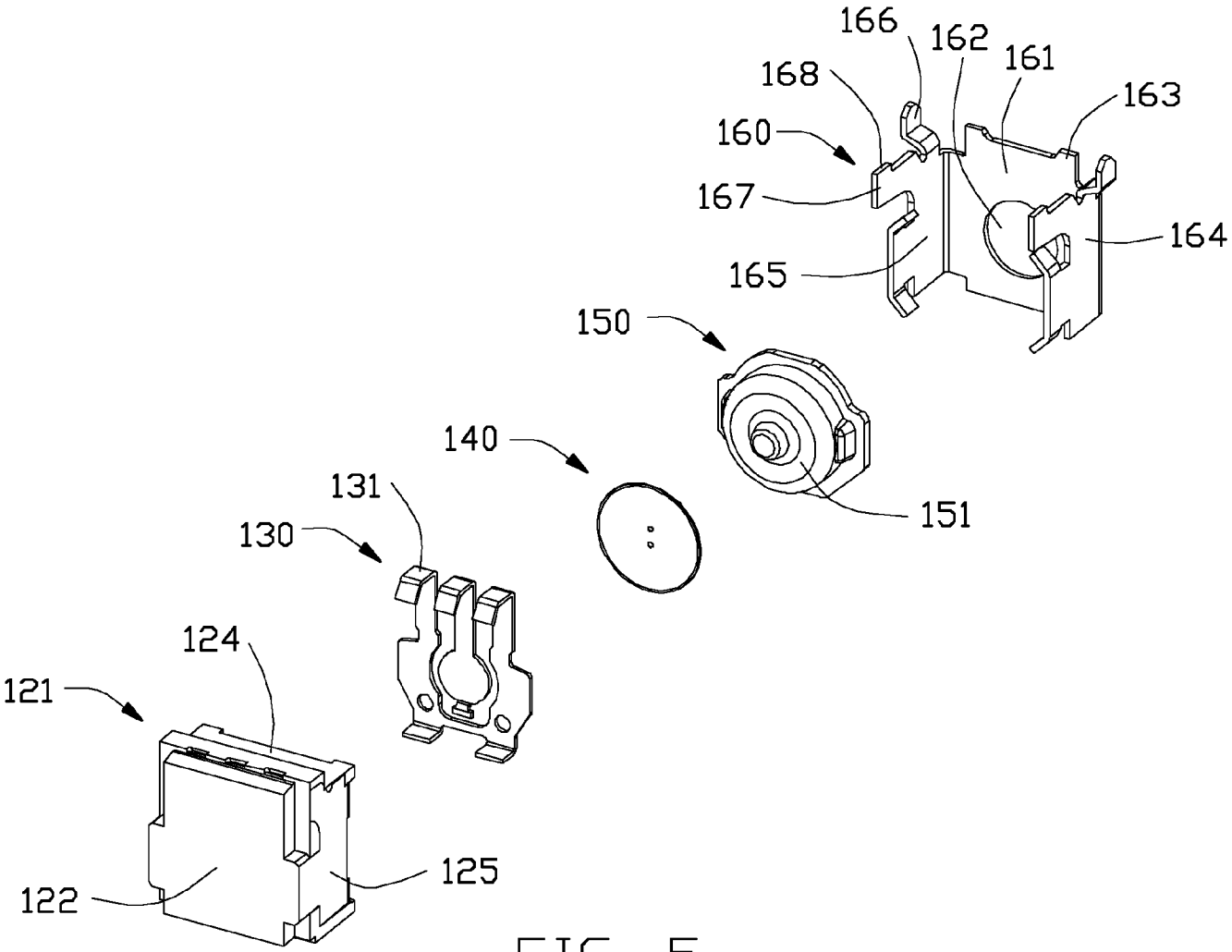
FIG. 5 is another exploded perspective view of the switch of FIG. 4.

Referring to FIGS. 1-5, an electrical switch assembly 100 includes an electrical switch 120 mounted upon a printed circuit board 110. The electrical switch 120 includes an insulative housing 121, a metallic cover 160 enclosing the housing 121. A set of fixed contacts 130, a moveable contact 140 and an operation part 150 of which all are enclosed in the housing 121.

The housing 121 includes a rear wall 122, and four side walls extending from the rear wall 122 and composed of opposite upper wall 123 and lower wall 124, and two side walls 125 linking both the upper wall 123 and the lower wall 124, wherein the rear wall 122, the opposite upper wall 123 and lower wall 125, and a pair of side walls 125 commonly form a receiving space 126. The set of fixed contacts 130 are mounted to the rear wall 122 and form three first soldering sections 131 extending beyond a bottom side of the housing 121 and soldered upon the printed circuit board 110 in a surface mounting manner. The movable contact 140 is mounted within the receiving space 126 along a front-to-back direction, and adapted to be contacted upon the corresponding set of fixed contacts 130 wherein the moveable contact 140 constantly connects to the two side pieces of the set of fixed contact 130 while only connects to the middle piece during deflection so as to form the switch function. The operation part 150 also assembled into the receiving space 126 along the front-to-back direction, and includes a main body l51 and a pressing portion 152 extending forwardly from the main body l51. The metallic cover 160 encloses the housing 121 and includes a front plate 161, and a pair of side plates 164 extending rearwardly from two opposite lateral sides of the front plate 161. The front plate 161 forms an opening 162, and a pair of second soldering section 163 for surface mounting to the printed circuit board 110. The side plate 164 includes a main body l65 and an extension 167 extending rearwardly from the main body l65 and beyond a rear side of the housing 121. A lower side of the main body l65 forms a pair of downwardly extending mounting legs or third soldering sections 166 for extending through the corresponding through holes in the printed circuit board 110. A lower side of each extension 167 forms a fourth soldering section 168 soldered upon the printed circuit board 110 in a surface mounting manner. The pressing portion 152 extends through the opening 162.

It is noted that the cover 160 includes four bent tabs (not labeled) abutting against the rear face of the housing 121 for preventing the cover 160 from being withdrawn from the hosing 121. On the other hand, the four protrusions (not labeled) are formed on a front face of the housing 121 for engagement with four recessed corners of the front plate 161 of the cover 160 for preventing a relative movement between the cover 160 and the housing 121 in a vertical plane defined by the front plate 161. It is noted that on each lateral side, the second soldering section 163, the third soldering section 166 and the fourth soldering section 168 are arranged in a triangular configuration in a top view wherein the third soldering section 166 extends beyond the corresponding side wall 125 or side face of the housing 121 and the fourth soldering section 168 extends beyond the rear wall 122 of the housing 121, thus strengthening the fastening effect.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical switch for mounting to a printed circuit board, comprising:

an insulative housing forming a receiving space extending along a front-to-back direction;

a set of fixed contacts retained in the housing;

a moveable contact movable in the front-to-back direction, disposed in the receiving space and selectively connecting to said set of fixed contacts;

an operation part assembled in the housing, and forwardly exposed to an exterior in said front-to-back direction, and further movable along said front-to-back direction to actuate said moveable contact to be moved in said front-to-back direction; and a metallic cover enclosing the housing and including a front plate covering said receiving space in said front-to-back direction, and a pair of side plates extending rearwardly from two lateral sides of the front plate; wherein each of said side plates includes a main body and an extension extending rearwardly from the main body beyond a rear face of the housing with a soldering section on a lower side of the extension for mounting to the printed circuit board; wherein, said front plate forms an opening through which the operation part extends along the front-to-back direction, wherein the metallic cover further includes a front plate attached upon a front face of the housing and covering the receiving space in said front-to-back direction, and said front plate further includes a front soldering section soldering upon the printed circuit board.

2. An electrical switch assembly comprising:

a printed circuit board;

an insulative housing seated upon the printed circuit board and defining a receiving space extending along a front-to-back direction;

a set of fixed contacts retained in the housing and having soldering portions soldered upon the printed circuit board;

a moveable contact received within the receiving space and moveable along the front-to-back direction to selectively mechanically and electrically connect the set of fixed contacts;

an operation part located in front of and covering the movable contact, said operation part being forwardly exposed to an exterior in said front-to-back direction and further moveable along said front-to-back direction to actuate said moveable contact;

a metallic cover assembled upon the housing and including a pair of side plates, each of said side plates including a main body covering a corresponding side wall of the housing, and an extension rearwardly extending from the main body beyond a rear face of the housing with a soldering section soldered upon the printed circuit board; wherein the metallic cover further includes a front plate attached upon a front face of the housing and covering said receiving space in said front-to-back direction, and said front plate further includes a front soldering section soldering upon the printed circuit board.

3. The electrical switch assembly as claimed in claim 2, wherein said front soldering section is coplanar with a front face of the housing.

4. An electrical switch for mounting to a printed circuit board, comprising:

an insulative housing adapted to be seated upon the printed circuit board defining a receiving space extending along a front-to-back direction;

a set of fixed contacts retained in the housing and having soldering portions for soldering upon the printed circuit board;

a moveable contact received within the receiving space and moveable along the front-to-back direction to selectively mechanically and electrically connect the set of contacts;

an operation part located in front of and covering the movable contact, said operation part being forwardly exposed to an exterior in said front-to-back direction and further moveable along said front-to-back direction to actuate said moveable contact;

a metallic cover assembled upon the housing and including a pair of side plates, each of said side plates including a main body covering a corresponding side wall of the housing, and an extension rearwardly extending from the main body beyond a rear face of the housing with a soldering section for soldering upon the printed circuit board; wherein the metallic cover further includes a front plate attached upon a front face of the housing and covering the receiving space in said front-to-back direction, and said front plate further includes a front soldering section soldering upon the printed circuit board.

5. The electrical switch assembly as claimed in claim 4, wherein said front soldering section and the soldering section and said another soldering section are arranged in a triangular configuration in a top view.

* * * * *